United States Patent [19]

Carella

[11] 4,012,043

[45] Mar. 15, 1977

[54] ARROW VANE

[76] Inventor: Richard F. Carella, 35572 Strathcona, Mount Clemens, Mich. 48043

[22] Filed: Feb. 14, 1974

[21] Appl. No.: 442,419

[52] U.S. Cl. ..... 273/106.5 C; 273/106.5 B

[51] Int. Cl.[2] ..... F41B 5/02

[58] Field of Search ..... 273/106.5 R, 106.5 B, 273/106.5 C; D22/12; D34/15 ZZ

[56] References Cited

UNITED STATES PATENTS

| | | | |
|---|---|---|---|
| 2,193,397 | 3/1940 | Dykes | 273/106.5 C |
| 2,212,345 | 8/1940 | Krieger | 273/106.5 R |
| 2,589,137 | 3/1952 | Ramsey | 273/106.5 B |
| 2,874,968 | 2/1959 | Zielinski | 273/106.5 B |
| 2,887,319 | 5/1959 | Lay | 273/106.5 C |
| 3,595,579 | 7/1971 | Benoit | 273/106.5 C |
| 3,672,677 | 6/1972 | Moore | 273/106.5 R |
| 3,756,602 | 9/1973 | Carella | 273/106.5 C |

*Primary Examiner*—Paul E. Shapiro
*Attorney, Agent, or Firm*—McGlynn and Milton

[57] ABSTRACT

An archery arrow comprising a shaft having a circular cross section with a forward end and a rearward end. The improvement comprises a vane system adjacent the rearward end of the shaft for stabilizing the flight of the arrow. The vane system comprises first and second vanes disposed diametrically opposite one another on the vane shaft. Each vane is defined by an integral member having an aerodynamic fin extending tangentially from one side of the shaft and supporting the vane so that the vane is spaced from the shaft, the spacing between the vane and the shaft decreasing from the forward end of the vane to the rearward end thereof so as to define a pocket between the vane and the shaft of decreasing volume from front to rear to create pressures upon the vane and the aerodynamic fin to cause the arrow to rotate.

A hunting arrowhead is also disclosed. The head includes two identical halves. Each of the halves includes a pair of planar sections with the planar sections of one-half abutting the planar sections of the other half, one of the planar sections of each half includes an outwardly extending fin. The fins are disposed on diametrically opposite sides of the arrow shaft and are inclined inwardly toward each other or toward the arrow shaft in a direction from front to rear.

12 Claims, 7 Drawing Figures

ARROW VANE

This invention relates to an improvement in archery arrows and, more specifically, to a stabilizing vane means attached to the rearward end of an arrow shaft. It has been common practice in the past to provide archery arrows with fletching feathers attached to the rear end of the arrow shaft to act as guide vanes or aerodynamic fins. These vanes create drag upon the arrow to stabilize the flight of the arrow during its trajectory. Feathers have been utilized because they are soft and flexible and therefore flex upon striking the bow as the arrow is being released, thereby avoiding interference with the flight of the arrow. Because the feathers are flexible and soft, they rapidly wear. Accordingly, attempts have been made to substitute smooth, rigid vanes for the feathered vanes to provide the desired planing or aerodynamic surfaces, yet avoiding wear problems. Because it has been desirous to utilize rigid vanes, vane assemblies have been utilized where the planar surfaces forming the vanes are disposed entirely on one side of the arrow so that they do not interfere or engage the bow upon release of the arrow. Examples of such vane assemblies are shown in U.S. Pat. No. 3,106,400 and applicant's own U.S. Pat. No. 3,756,602.

It has been recognized that the flight of an arrow is much more accurate when the arrow has a faster rotation. This is particularly true with hunting arrows which have points or arrowheads which may plane or cause an adverse aerodynamic effect upon the arrow when the arrow is not properly rotated. Another important consideration which must be given arrow vane systems is the ease by which attachment to the arrow shaft can be made. As will be appreciated, it is sometimes very difficult to attach feathered fletching to an arrow shaft, particularly in the field.

Applicant has for a number of years been striving to perfect an arrow vane assembly which overcomes the problems associated with the prior art archery vane assemblies while providing results not attainable by known archery vane systems. Applicant has made various contributions to the art as a result of such development work. The first such contribution is disclosed and claimed in U.S. Application Ser. No. 97,824, filed Dec. 14, 1970 and directed to a vane system which is disposed completely on one side of the arrow shaft and includes vanes extending radially from an axis spaced from the arrow shaft. Subsequently, applicant developed a system which is shown in U.S. Pat. No. 3,756,602 (referred to above) wherein the vanes are disposed on one side of the shaft and slant or are inclined downwardly from the forward end to the rearward end thereof relative to the axis of the shaft. Yet a further contribution to the art is exemplified in applicant's co-pending application Ser. No. 402,303, filed Oct. 1, 1973, wherein the vane system includes a pair of vanes disposed on one side of the shaft with one of the vanes angled upwardly from front to rear and the other vane angled downwardly from front to rear.

All of these prior contributions by applicant are a result of efforts to develop a vane system which would not interfere with the bow upon release of the archery arrow and which would provide the most stable, efficient and accurate flight characteristics in the arrow. The instant invention is the latest result of applicant's efforts and is directed to a vane assembly for an archery arrow which provides better characteristics and results than any previously known vane system as has been proven by actual use and wind tunnel tests. Such is accomplished by a vane system including two vanes disposed on diametrically opposite sides of an arrow shaft with each vane being spaced from the arrow shaft and inclined upwardly or outwardly from the vane shaft in a direction from front to rear extending coextensively with the diameter of the shaft so as not to interfere with the bow upon release of the arrow. The vanes are supported in spaced relationship to the shaft support means defined by oppositely disposed aerodynamic fins extending from diametrically opposite sides of the shaft tangentially to the circumference of the shaft in opposite but parallel directions. The aerodynamic fins extend generally parallel to the notch in the rear of the arrow which engages the bowstring whereby the two vanes are disposed perpendicularly to the bowstring when the arrow shaft is in the nocked position so as to prevent interference of the vanes with the bow upon release of the arrow.

Other advantages of the present invention will be readily appreciated as the same becomes better understood by reference to the following detailed description when considered in connection with the accompanying drawings wherein.

Referring now to the drawings wherein like numerals indicate like or corresponding parts throughout the several views, an arrow constructed in accordance with the instant invention is generally shown at 10.

The arrow 10 includes a shaft 12, which includes a circular outer periphery as may be defined by a tubular or solid element comprising tubular aluminum, solid wood or other material suitable for use in archery arrows. The shaft 12 has a forward end upon which is disposed a hunting head, generally indicated at 14, and a rearward end upon which is disposed the vane system, generally shown at 16. The arrow is supported in the nocked position by an arrow support 17.

Figure 1:
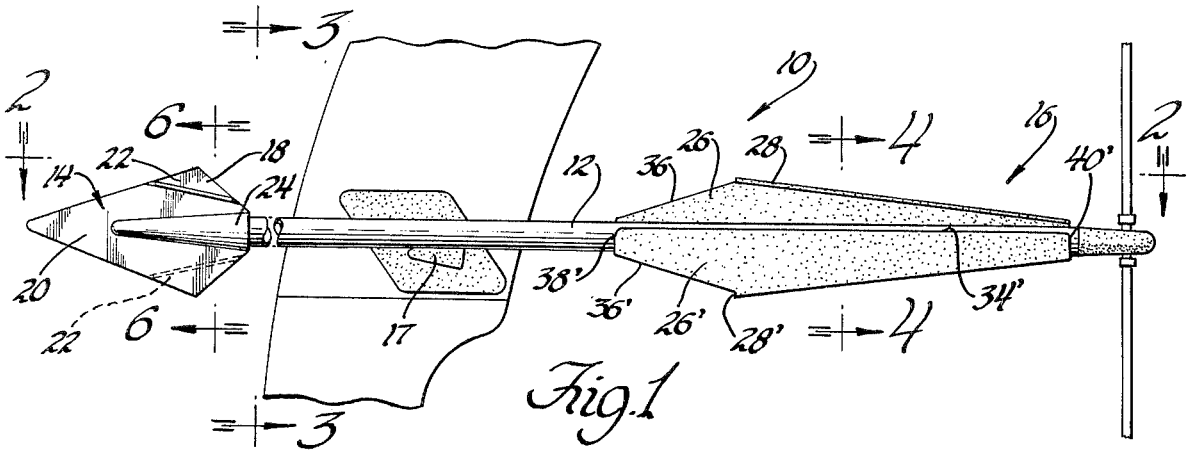
FIG. 1 is a fragmentary side elevational view of a preferred embodiment of the subject invention shown in the nocked position with an archery bow.
Figure 2:
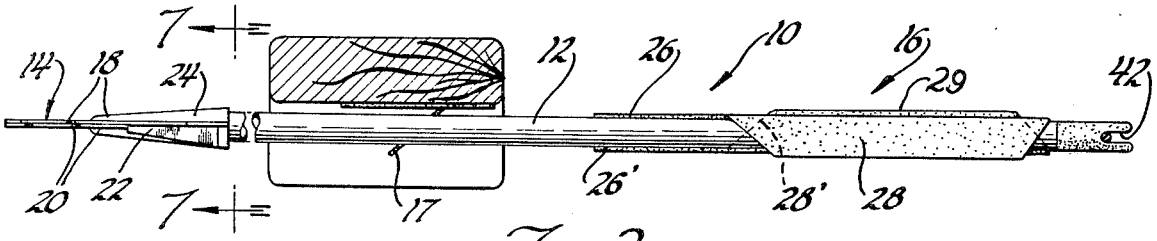
FIG. 2 is a plan view taken substantially along line 2—2 of FIG. 1.

The hunting head 14 comprises two identical halves 18 and 20. Each of the halves 18 and 20 have a pair of planar sections which abut a pair of planar sections of the other half. One of the planar sections of each of the pairs includes an outwardly extending extremity or aerodynamic fin 22 which extends laterally outwardly from the adjacent planar section of the other half. The planar sections define aerodynamic fins or vanes as do the outwardly extending extremities 22. The outwardly extending extremities 22 of the halves 18 and 20 are diametrically disposed on opposite sides of the arrow shaft and are inclined inwardly toward each other or toward the arrow shaft in a direction from front to rear as is best illustrated in FIG. 1. The central portion of each half is defined by an arcuate or truncated cone section 24, which is adapted to receive the arrow shaft 12. The halves are integral members and may be secured together by an adhesive, brazing, welding, or the like, depending upon whether the arrowhead is made of a plastic or metal material.

The extremities 22 which extend laterally from the planar sections of the arrowhead halves 18 and 20 are disposed so as to stabilize the flight of the arrow by inducing rotation of the arrowhead and consequently rotation of the arrow shaft.

Figure 5:
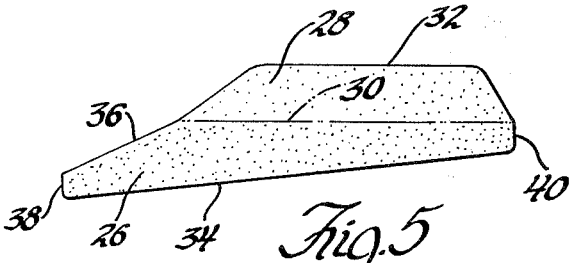
FIG. 5 is a view of an integral element in the flat shape before being folded along a crease or fold line for defining a vane member of the instant invention.
Figure 6:
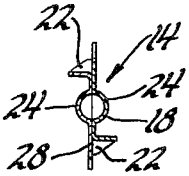
FIG. 6 is a cross-sectional view taken substantially along line 6—6 of FIG. 1.
Figure 7:
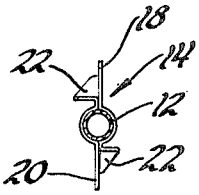
FIG. 7 is a cross-sectional view taken substantially along line 7—7 of FIG. 2.

The arrow assembly or system 16 is defined by a pair of identical integral members which are formed from blanks of the shape shown in FIG. 5. Each integral member defines a support means comprising an aerodynamic fin 26 or 26'. Since each arrow shaft 12 employs two identical integral members, the identical parts of the two integral members will be designated by like numbers with one of the numbers being designated by a prime (').

Each integral member also defines a vane 28 or 28' which extends laterally from the associated fin 26 or 26'. Each vane portion 28 or 28' is spaced from the shaft 12 and on the same side of the associated aerodynamic vane 26 or 26' as the shaft 12 so as to extend over the shaft 12. More specifically, each vane 28 or 28' is substantially coextensive with the diameter of the arrow shaft so that when the arrow is in the nocked position illustrated best in FIG. 3, the vanes will not interfere with the bow upon forward movement of the arrow upon release. As actually illustrated, the vanes 28 and 28' each extend beyond the extremity of the shaft as shown at 29 but not enough to interfere with the bow upon release of the arrow.

Each vane 28 and 28' is disposed so that the spacing between the vane and the shaft 12 decreases from the forward end of the vane, or the end of the vane nearest the forward end of the shaft 12, toward the rear end of the vane, or the end of the vane nearest the rearward end of the shaft 12, so as to define a pocket between each vane 28 and 28' and the circumference of the shaft 12 which is of decreasing volume in a direction from front to rear. As an alternative, instead of the pocket of decreasing volume being defined between the vane 28 or 28' and the shaft 12, the pocket may be defined by the vane 28 or 28' and a second vane extending laterally or transversely of the support fins 26 or 26'. Such a second vane may be generally parallel to the arrow shaft 12 or may be inclined or at an angle other than 180° relative to the axis of the shaft 12.

Figure 3:
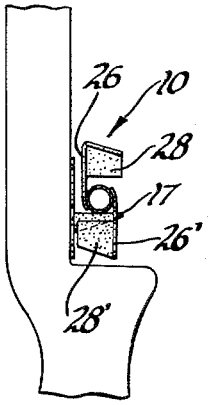
FIG. 3 is a cross-sectional view taken substantially along line 3—3 of FIG. 1.

As best illustrated in FIG. 3, the support means defined by the aerodynamic fins 26 and 26' extend tangentially from the shaft 12 in a direction which is opposite to one another but yet parallel to one another. In other words, the aerodynamic fin 26 extends tangentially from the shaft 12 in a direction which is opposite to but parallel to the direction in which the aerodynamic fin 26' extends from the shaft 12. As illustrated, the aerodynamic fins 26 and 26' are adhesively secured to the arrow shaft 12.

As alluded to hereinabove, each vane unit is defined by an integral member comprising, for the purpose of description, an aerodynamic fin 26 or 26', which defines support means, and a vane 28 or 28'. As will be appreciated, however, both the aerodynamic fins 26 and 26' and the vanes 28 and 28' are air foils producing an aerodynamic result upon movement through the air.

The integral member as shown in FIG. 5 has a crease or fold line 30, which extends longitudinally therealong. The vane 28 extends from the crease or fold line 30 to an outer edge 32, which extends generally parallel to the crease or fold line 30. The aerodynamic fin 26 extends in another direction from the crease or fold line 30 to a lower edge 34. The lower edge 34 is inclined or slanted toward the crease or fold line 30 in a direction from the front to the rear. The integral member as shown in FIG. 5 is shown in the position before being folded along the crease or fold line 30 to dispose the vane 28 in a direction substantially 90° to the plane of the aerodynamic fin 26. The aerodynamic 26 includes a nose portion defined by an upper edge 36 which extends in an inclined direction downwardly and forwardly from the forward end of the crease or fold line 30 toward the lower edge 34. The nose portion of the aerodynamic fin includes a front edge 38 which extends between the forward end of the upper edge 36 and the forward end of the lower edge 34. Also included is a rear edge 40 extending between the rearward end of the lower edge 34 and the rearward end of the crease or fold line 30.

Figure 4:
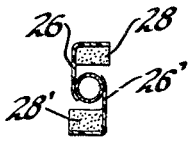
FIG. 4 is a cross-sectional view taken substantially along line 4—4 of FIG. 1.

Preferably, the lower edge 34 or 34' of each integral member includes a strip of adhesive which may be pressed against the arrow shaft 12 for retaining the integral unit to the shaft. The lower edge 34 is disposed generally parallel to the axis of the shaft 12 so that the associated vane 28 or 28' is disposed in spaced relationship to the shaft but in a plane which slants downwardly from front to rear to define a pocket of decreasing volume. As the arrow moves through the air, pressure builds up in the pocket to create a pressure against each aerodynamic vane 26 and 26' to urge the arrow to rotate in a counterclockwise direction, as viewed in FIGS. 3 and 4. Of course, the pressure buildup also acts radially outwardly against the vanes 28 and 28'.

The notch 42 at the end of the arrow shaft 12 is disposed in a direction which is parallel to the aerodynamic fins 26 and 26' whereby the vane assembly is disposed as shown in FIG. 3 so that the vanes 28 and 28' do not interfere with the bow upon release of the arrow, yet are disposed diametrically on opposite sides of the arrow shaft 12. As alluded to above, the aerodynamic fins 26 and 26' are generally parallel to one another and perpendicular to a diameter of the arrow shaft, which is, in turn, perpendicular to the notch 42 in the end of the arrow shaft.

The vane units are preferably made of a thin pliable plastic material which may flex but returns to its original configuration. In fact, actual tests have shown that arrow as shown at 10 may be pulled through a bale of straw and the vanes system will not be damaged because each vane wraps itself tightly about the shaft to pass through the bale and returns to its original shape upon leaving the bale.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, the invention may be practiced otherwise than as specifically described.

The embodiments of the invention in which an exclusive property or privilege is claimed are defined as follows:

1. An arrow comprising a shaft with a forward end and a rearward end, support means extending tangentially from said shaft, vane means extending laterally from said support means on the same side of said support means as said shaft so as to extend over said shaft, said vane means defining a pocket of decreasing volume from front to rear to effect a pressure buildup causing rotation of the arrow during flight.

2. An arrow comprising a shaft with a forward end and a rearward end, first support means extending tangentially from said shaft, a first vane extending laterally from said first support means at a position spaced from said shaft and on the same side of said first support means as said shaft so as to extend over said shaft, said first vane being disposed with the spacing between said first vane and said shaft decreasing from the end of said first vane nearest the forward end of said shaft to the end of said first vane nearest the rearward end of said shaft to define a pocket of decreasing volume from front to rear.

3. An arrow as set forth in claim 2 wherein said first vane is wide enough to be at least coextensive with the diameter of said shaft.

4. An arrow as set forth in claim 2 wherein said first support means is defined by an aerodynamic fin.

5. An arrow as set forth in claim 4 wherein said first vane and said aerodynamic fin are defined by an integral member having a crease line extending therealong, said first vane extending from said crease line to an outer edge extending generally parallel to said crease line, said aerodynamic fin extending in another direction from said crease line to a lower edge which is inclined toward said crease line in a direction from front to rear.

6. An arrow as set forth in claim 5 wherein said aerodynamic fin includes a nose portion defined by an upper edge extending in an inclined direction downwardly and forwardly from the forward end of said crease line toward said lower edge.

7. An arrow as set forth in claim 6 wherein said aerodynamic fin includes a front edge extending between the forward end of said upper edge and the forward end of said lower edge and a rear edge extending between the rearward end of said lower edge and the rearward end of said crease line.

8. An arrow as set forth in claim 2 including a second vane identical to said first vane and disposed diametrically opposite to said first vane.

9. An arrow as set forth in claim 8 including a second support means extending tangentially from said shaft in a direction opposite and parallel to said first support means.

10. An arrow as set forth in claim 9 wherein said first and second support means are respectively defined by first and second aerodynamic fins.

11. An arrow as set forth in claim 10 wherein said first aerodynamic fin and said first vane are defined by a first integral member and said second aerodynamic fin and said second vane are defined by a second integral member.

12. An arrow as set forth in claim 11 wherein said aerodynamic fins are adhesively secured to said shaft.

* * * * *